United States Patent [19]

Barker

[11] Patent Number: 4,944,225

[45] Date of Patent: Jul. 31, 1990

[54] METHOD AND APPARATUS FOR FIRING EXPLODING FOIL INITIATORS OVER LONG FIRING LINES

[75] Inventor: James M. Barker, Katy, Tex.

[73] Assignee: Halliburton Logging Services Inc., Houston, Tex.

[21] Appl. No.: 433,305

[22] Filed: Nov. 8, 1989

Related U.S. Application Data

[63] Continuation-in-part of Ser. No. 175,961, Mar. 31, 1988, abandoned.

[51] Int. Cl.[5] ..... F42B 3/10; F42C 19/12

[52] U.S. Cl. ..... 102/202.5; 102/242.7

[58] Field of Search ..... 102/202.5, 202.7, 202.9

[56] References Cited

U.S. PATENT DOCUMENTS 2,399,034 4/1946 Huyett et al. .
3,366,055 1/1968 Hollander, Jr. .
4,471,697 9/1984 McCormick et al. .
4,762,067 8/1988 Barker et al. .
4,819,560 4/1989 Patz et al. .
4,862,803 9/1989 Nerheim et al. .

*Primary Examiner*—Charles T. Jordan
*Assistant Examiner*—Richard W. Wendtland
*Attorney, Agent, or Firm*—William J. Beard

[57] ABSTRACT

A method and apparatus for use in well perforating systems and disclosed for firing slapper on exploding foil initiator over relatively lengthy firing lines. Specially designed detonators or initiators of the exploding foil or slapper type are used wherein the type of material used and/or the geometry of the exploding foil causes electrical preloading of the firing lines from the firing pulse generator to the detonator or initiator. The preloading prevents premature inductive and resistive disposition of the high intensity firing pulse traversing the firing lines.

13 Claims, 2 Drawing Sheets

FIG. 1
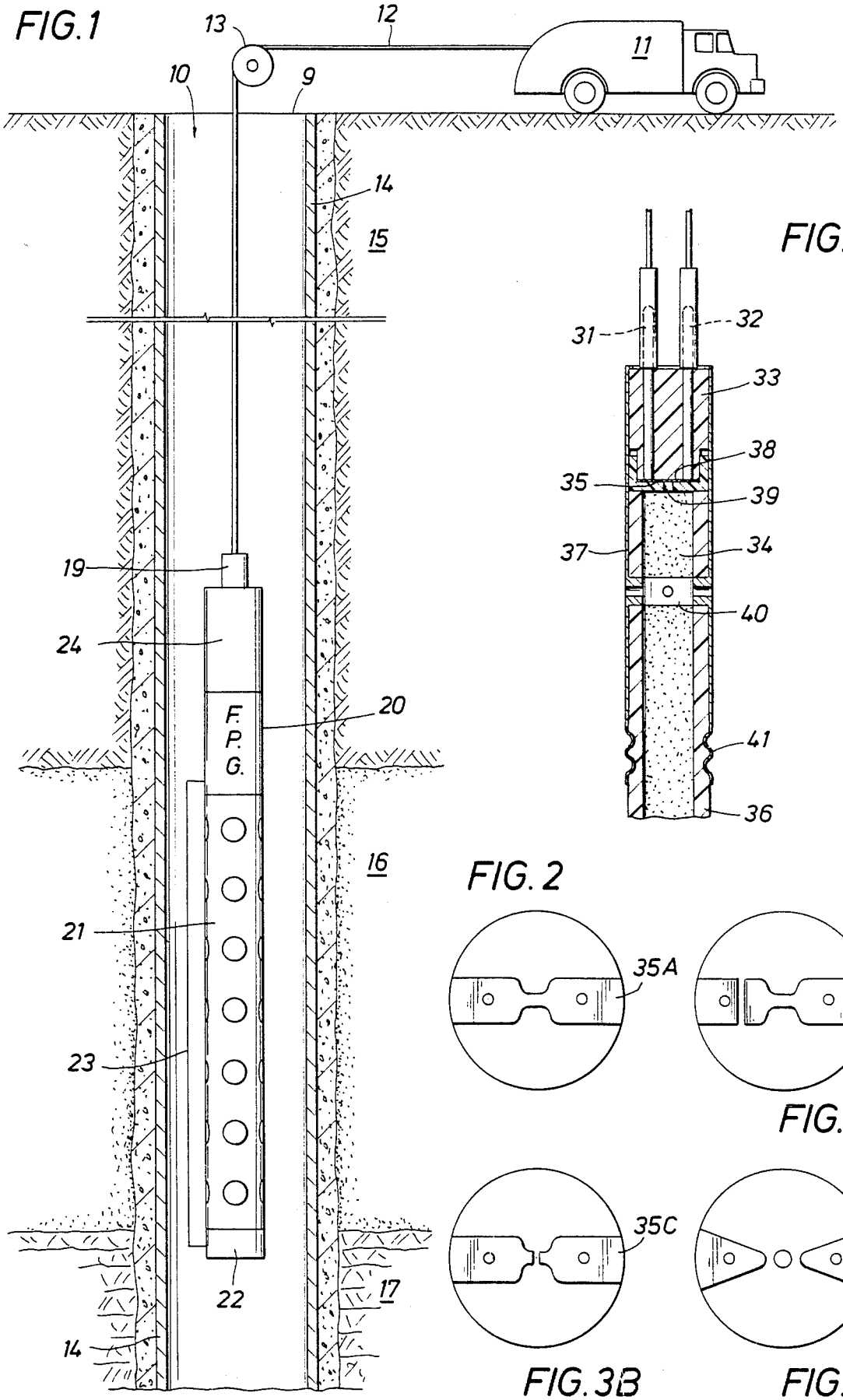
FIG. 1A
FIG. 2
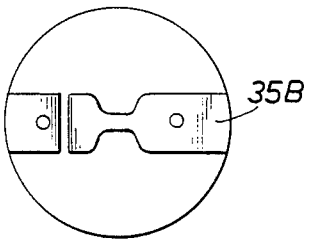
FIG. 3A
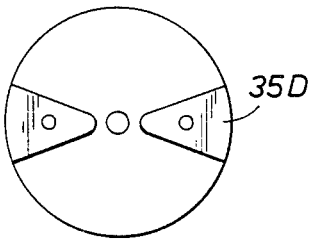
FIG. 3B
FIG. 3C

METHOD AND APPARATUS FOR FIRING EXPLODING FOIL INITIATORS OVER LONG FIRING LINES

This application is a continuation in part of prior application Ser. No.07/175,961 filed Mar. 31, 1988, and now abandoned.

BACKGROUND OF THE DISCLOSURE

In modern completion technology presently used for completing oil wells, it is possible to fire wireline perforating guns that may be as long as forty feet. In firing these relatively long strings of perforating guns, the shaped charges carried by the guns are typically connected to each other by a detonating cord which passes through or near the apex of each of the conically shaped charges. The primacord or detonating cord joins them all together. The detonating cord is typically fired by a detonator, or initiator, that is located at the lower end of the gun. The reason for placing a detonator at the bottom of the gun is to allow it to become disabled by well fluids, should the perforating gun have a leak. Experience has shown that firing a perforating gun which is full, or partially full, of fluid is catastrophic. Upon firing a fluid-filled gun, severe expansion, or possibly even rupturing, of the outer housings result. Thus it is possible to leave swollen housing inside the well bore, depriving the well operator from producing oil or gas from that particular zone until the housing are removed, usually by expensive fishing operations.

Particularly in the case of relatively long strings of hollow carrier perforating guns which are to be fired from below or from the lower end of the string, it has been desirable to use explosive initiators of the slapper type or exploding foil type for safety purposes. Explosive initiators of the slapper type or exploding foil initiator type are inherently safer than previously used explosive initiators or blasting caps, because a less sensitive secondary explosive may be used in initiators of this type. The relatively lower sensitivity secondary explosive used in this type of detonator requires a higher energy to cause its detonation. This is provided in the case of the exploding foil initiator by a sudden high volatge, high current pulse of electricity which is applied across a thin foil of conducting material and which causes it to violently and rapidly vaporize, and subsequently propel or slap a flyer against the secondary high explosive mixture used in the detonating cap.

Thus, the use of exploding foil initiators at the bottom end of lengthy strings of perforating guns requires the generation of a high voltage, high intensity electrical pulse or spike which must be supplied to the exploding foil or slapper type initiator in order to cause its detonation. This can present a problem, particularly since the electronic power supply typically used for providing the high volatge, high current spike is housed at the upper end of the string of perforating guns. Thus, it is necessary to conduct the high voltage, high current spike over a relatively lengthy firing line and still supply it to the exploding foil or slapper type initiator with sufficient voltage amplitude and current intensity to cause detonation of the slapper or exploding foil type detonator.

One method to deliver the necessary high voltage, high current pulse to the slapper type initiator, is by the use of coaxial cable or flat cable having a low resistance and low inductance. This cable can be connected from the power supply at the top of the string to the initiator at the lower end. However, the geometry and size requirements of the perforating guns typically used can usually prevent the use of the necessary sizes of coaxial or flat cable required to conduct the sharp pulse over a relatively long length, such as thirty or forty feet. The system and method of the present invention overcomes these problems without the use of special coaxial or flat cable.

BRIEF DESCRIPTION OF THE INVENTION

A method of firing an exploding foil or slapper type initiator over a relatively long firing line up to thirty or forty feet is provided in the present invention. The slapper type or exploding foil initiator used is of itself of special design according to concepts of the present invention. This detonator is used in conjunction with a high voltage, high current power supply and conventional electrical conductors, in order to conduct a high voltage, high current spike to the specially designed exploding foil or slapper type initiator. In the slapper type initiator, in one configuration, a high resistance but still conductive bridge is used to cause an electrical loading of the line prior to the transmission of the high voltage, high current amplitude spike. This preserves the integrity of the high voltage, high current spike reaching the slapper or exploding foil portion of the initiator. In another configuration according to the present invention, a controlled gap using any of several different possible geometries can be used in order to cause electrical pre-loading of the line from the high voltage, high current power supply to the exploding foil or slapper initiator. In this device a controlled gap causes a preloading of the line or electrical buildup of the line which conducts the high voltage, high current spike to the initiator in a much more efficient manner than by merely transmitting the high voltage, high current spike down the line to initiators as previously known in the art.

The foregoing concepts as described in the brief description of the invention will be better understood by reference to the detailed description to follow when taken in conjunction with the accompanying drawings.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 4:
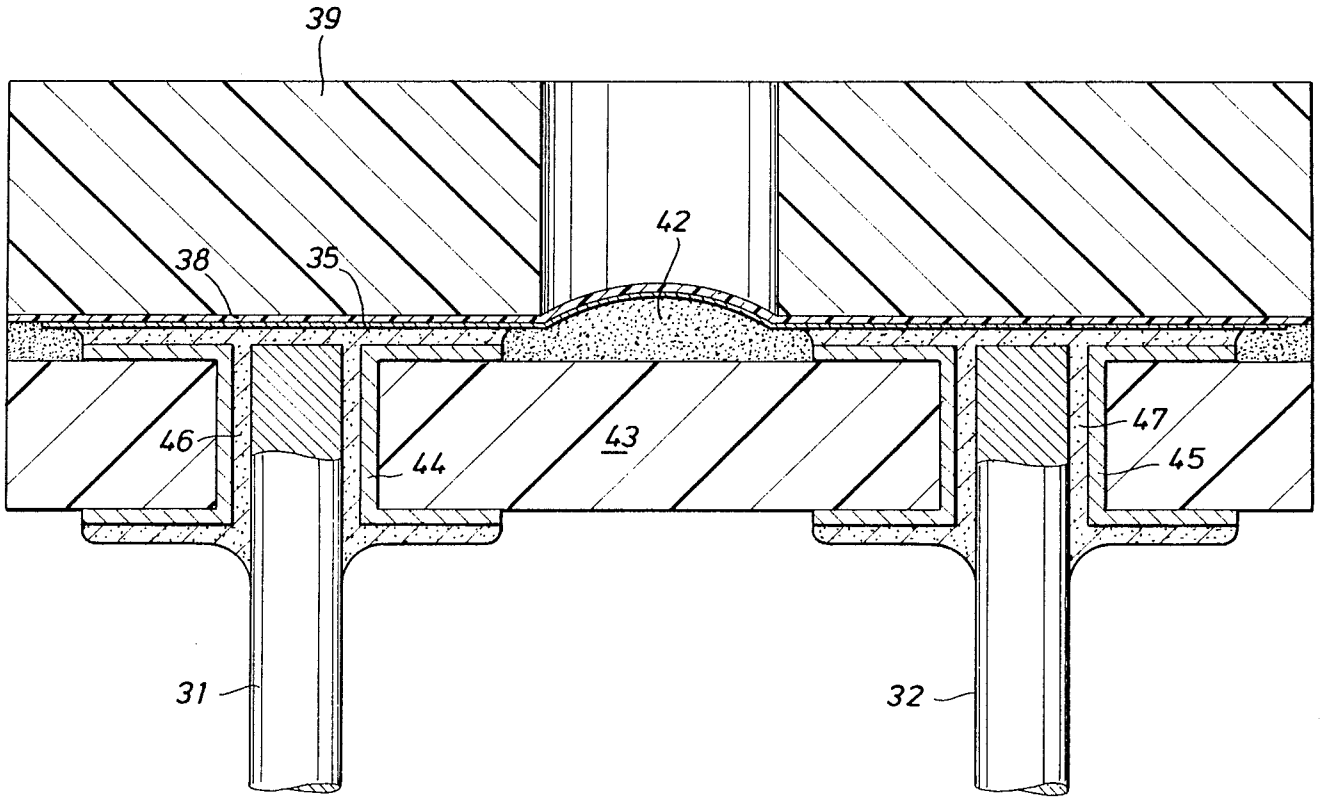

FIG. 1 is a schematic diagram illustrating a perforating system utilizing concepts of the present invention.

FIG. 1A is a detail showing the construction of a slapper or exploding foil type initiator as used in the system according to the concepts of the invention.

FIG. 2 shows an embodiment of a portion of the initiator of FIG. 1A according to concepts of the invention.

FIGS. 3A, 3B and 3C show an exploding foil or slapper initiator having gaps for use in the system according to concepts of the invention.

FIG. 4 is an enlarged sectional view of the exploding foil and flyer for explosive detonation.

DETAILED DESCRIPTION OF THE PREFERRED EMBODIMENTS

Referring initially to FIG. 1, a wireline conveyed perforating system using concepts according to the present invention is illustrated schematically. It will be understood that while the invention is illustrated in FIG. 1 with respect to a wireline conveyed perforating system, that it could be adapted for use with tubing conveyed perforating systems utilizing long strings of perforating guns and using slapper type or exploding foil type initiators to detonate the string of perforating guns from the lower end.

In FIG. 1, a well bore hole 10 which is typically filled with a bore hole fluid (not shown) penetrates earth formations 15, 16 and 17 and is lined with a steel casing 14. A relatively long string of perforating guns 21 which could be up to thirty or forty feet in length is illustrated suspended in the well bore by a wireline 12. A well logging truck 11 is shown at the surface having a wireline 12 which is suspended over a sheave wheel 13 and connects with a firing pulse generator portion of the down hole assembly 20. A cable head 19 and collar locator 24 are located above the firing pulse generator 20.

Typically the string of perforating guns is run in the well from the surface on the wireline 12 and positioned at the proper depth using the collar locator 24. The perforating gun assembly contains the firing pulse generator 20 at its upper end and an initiator 22 at its lower end which is connected to the firing pulse generator by an electrical conductor or conductors 23. The conductors are actually located inside the gun, but have been schematically shown outside. The initiator 22 is shown in more detail at FIGS. 1A and 4 and comprises a slapper type or exploding foil type initiator as illustrated therein.

Referring now to FIG. 1A, the initiator is seen to comprise an upper cap portion 33 which may be formed of a molded plastic or the like and which contain molded therein two electrical conductors 31 and 32 and a slapper foil or initiator foil 35. A thin disc 38, constructed from an insulting material such as plastic, is placed over the foil 35. A barrel 39 is placed over the thin disc 38 to sandwich it (the disc 38) tightly against the foil 35. A housing 37 contains a pressed pellet 34 of a secondary explosive material which is in intimate contact with the barrel 39. Across an air gap 40 from the secondary explosive material and crimp 41 connected to the initiator 22 is a detonating cord 36 which runs upwardly through the perforating gun assembly 21 and connects each shaped charge in the perforating gun assembly to the detonating cord for detonating purposes. The cord 36 is typically several feet long to provide connection to a set of shaped charges deployed above the initiator 22. Therefore, the cord 36 is detonated from the bottom and is consumed from bottom to top to detonate multiple shaped charges. In operation, typically, a high voltage pulse is applied between conductors 31 and 32.

Typically, an electrical high voltage, high intensity current pulse is supplied between electrical conductors 31 and 32 in a manner sufficient to vaporize or cause the foil component 35 to be literally exploded or vaporized and to cause a flyer to be formed from the plastic disc 38 by the shearing action of the edges of the barrel 39. The flyer is profiled by the surrounding cutting edge and is forced by high pressure plasma gases along the barrel hole in the fashion of a projectile. The flyer is propelled down the barrel 39 until it impacts the secondary explosive 34, detonating the secondary explosive 34 which, in turn, detonates detonating cord 36 connecting the string of shaped charges from its lower end toward its upper end in the firing gun assembly 21 of FIG. 1.

It will be observed that a relatively long electrical conductor 23 is required to pass the high voltage, high current spike from the firing pulse generator 20 to the explosive initiator 22 which is located at the lower end of the string of perforating guns for the reasons previously discussed. The use of low resistance, low inductance electrical conductors in the line 23 is very desirable, but still it has been found that over extremely long firing lines, the high voltage, high intensity current spike produced by the firing pulse generator 20 can be deteriorated prior to its reaching the initiator 22. The concept of the present invention is to electrically preload the firing line 23 by use of a specially designed exploding foil initiator or slapper detonator 22 in the system. Embodiments of this device are shown in FIGS. 2 and 3A, 3B, 3C and 4.

The element 35A shown in FIG. 2 corresponds to the exploding foil element 35 of the detonator of FIG. 1A. In the element 35A of FIG. 2, a high resistance bridge having a necked down portion is illustrated. The high resistance bridge may be comprised of a higher resistance material than the copper or aluminum foil usually encountered in exploding foil or slapper detonators. For example, the material may comprise nichrome or other alloys of increased resistance. In this instance, the high resistance of the bridge 35A in element 35 or the detonator of FIG. 1A causes the initial high voltage, high current spike to preload or electrically charge up the firing line prior to the level of peak current flow reaching the high resistance bridge 35A. This causes the delivery of a more uniform high voltage, high current spike to the exploding foil or slapper part of the detonator.

Other configurations of the exploding foil or slapper of the detonator in FIG. 1A are illustrated in FIGS. 3A, 3B and 3C. In this alternate embodiment, a controlled gap is left in the exploding foil or slapper element 35A, 35B, 35C and 35D. When the initial high voltage pulse is delivered to the firing line 23 of FIG. 1, the line is preloaded because the current cannot flow through these controlled gaps prior to the build-up of a critical breakdown voltage. The breakdown voltage is that which is required for the voltage to cause an arc across the controlled gap in the foil. Once the critical breakdown voltage is reached, current can then flow across the gap and the slapper explodes or vaporizes in the usual manner associated with slapper type, or exploding foil type, initiators. In this instance, the material of the slapper itself may still be a good conductor such as copper or aluminum foil as desired; it is the intensity of the current passing through the relatively thin cross section material (after current flow is established across the control gap) that causes the exploding or slapping type initiation of the detonator to take place.

The use of the high resistance or controlled gap exploding foil or slapper type detonators according to the concepts of the invention in conjunction with the high voltage, high current firing pulse generator 20 of FIG. 1 enables the use of ordinary type electrical conductors for line 23 of FIG. 1 even in the instance where thirty to forty feet of line is between the firing pulse generator 20 and the initiator 22. Thus the necessity for using special coaxial or flat electrical cables for this purpose is avoided and improved initiation or detonation of the entire explosive string is achieved.

FIG. 4 of the drawing is an enlarges view showing various layers of structure of another embodiment of an exploding foil or slapper detonator corresponding to the disclosure of FIGS. 1 and 1A. The layers have been exaggerated in thickness to adequately illustrated them; the exaggeration and enlargement must be understood in the context of the actual structure. The foil layer 35 is shown in edge view. It will, however, have the narrow bridge portion exemplified in FIGS. 2 or 3A to 3C of the drawings as previously described. In any event, the foil layer is conveniently constructed by use of printed circuit board (PCB) material which is the supportive substrate 43 shown in FIG. 4 and which comprises a layer abutted against the barrel 39 of FIG. 1A. Two holes are formed in the PCB and the holes are lined with conductive material. They are known as plated through holes, where the plating material is identified at 44 and 45. That is, the cylindrical eyelets 44 and 45 are fabricated in the PCB 43 with the plated through technique. The conductors 31 and 32 are held in place by a layer of solder indicated at 46 and 47. The solder fills the annular space between the wires 31 and 32 and the plated through holes 44 and 45. The solder (as result of surface tension) forms a fillet around the ends of the wires and also fills the eyelets making up the plated through holes and extends somewhat on both ends of the plated through holes. A rubber type adhesive such as Dow Corning Q2-7406 is applied to laminate the foil layer 35 to the PCB 43. This adhesive layer identified at 42 has a finite cure interval so that some adhesive is forced into a bead when the components are pressed together during lamination as described below. The adhesive 42 tends to flow toward the hole in the barrel 39. It forms a slight bulge at the hole. Moreover, it adheres to the foil 35 and serves as a vapor seal which confines plasma generated vapors when the electrical pulse for detonation is delivered.

The foil 35 and the disc 38 are obtained as a sandwich stack material. That is, they are initially joined to one another. The foil is typically copper cladding joined to a flexible polymeric plastic sheet. One acceptable product is sold under the trademark MICROCLAD which describes a copper clad composite sheet material having a plastic base layer which is known by the trademark KAPTON and is often used to make flexible printed circuit boards. The entire face of the KKAPTON layer is covered with copper but, by appropriate etching, it can be removed to obtain the current conductive hour glass shape which is shown in FIGS. 2 and 3A to 3C. After etching, the foil has a measured width. Typical thicknesses are in the range of 0.0002 inches. The copper foil 35 and the KAPTON backing layer 38 thus comprise a unitary structure which is also affixed to the electrical leads 31 and 32 by soldering (see the solder 46 and 47 in FIG. 4) after applying the adhesive 42 over the PCB surface. The adhesive 42 tends to form a bead or bubble which has been exaggerated in height in FIG. 4. When the barrel 39 is squeezed against the PCB laminated MICROCLAD sheet material including the disc 38, surplus adhesive forms the bead. This bead actually enlarges the size of the flyer cut from the disc 38 when the foil is vaporized to form the flyer.

When a high voltage, high current discharge is made into the system, the current flows through the narrow neck portion of the copper or aluminum foil. The foil is heated almost instantaneously. Heat liberated at this juncture is sealed in the region by the adhesive 42 as previously mentioned. This confines the plasma related vapors. Temperatures increase so that the metal neck portion in literally vaporized and forms a plasma at temperatures approaching 40,000° F. The extremely high temperature achieved in the confined plasma beneath the disc 38 causes a plastic (KAPTON) flyer to be cut by the edge of the circular hole in the barrel 39 which shears the sheet plastic into a circular flyer. The flyer diameter is larger than the hole in the barrel 39 because of the initial bulge under it formed by the surplus adhesive 42. The plastic flyer disc is momentarily sealed in the open passageway through the barrel 39. The disc is consequently shot as a projectile by the expanding hot plasma gas confined behind it. The disc is accelerated through the open passage in the barrel 39 and impacts the secondary explosive 34, causing detonation. Secondary explosives can be handled much more safely because they are less sensitive to shock or other external stimuli capable of causing premature detonation.

The above descriptions may make other alternative embodiments according to the concepts of the invention apparent to those of ordinary skill in the art. It is the aim of the appended claims to cover all such changes and modifications as file within the true spirit and scope of the invention.

What is claimed is:

1. An initiator for detonation of an elongate explosive cord extending to plural shaped charges in a well borehole, the initiator comprising:

(a) a closed housing connected to an elongate explosive cord;

(b) secondary explosive charge means in said housing positioned relative to said explosive cord to detonate said cord and wherein said charge means has an exposed face;

(c) a transverse structural member disposed against said exposed face and having a passage therein wherein said passage has a face end against said exposed face and spaced from a remote end;

(d) a sheet member of electrically insulated material spanning said remote passage end and attached to said structural member by an adhesive means;

(e) a sacrificial metal foil member adjacent to said sheet member and aligned with said passage end;

(f) a pair of electrical conductors connected into said housing for electrical connection to said metal foil to deliver current through said housing to vaporize said foil on sufficient current flow; and (g) wherein said housing confines vaporization of said metal foil to cause detonation through said passage toward said charge means face.

2. The apparatus of claim 1 wherein said housing includes a printed circuit board having a surface, and wherein said foil is supported on said surface by an adhesive layer.

3. The apparatus of claim 2 wherein said remote opening end forms a cutting edge for cutting said sheet material into an opening shaped disc urged by foil vaporization to detonate said charge means.

4. The apparatus of claim 3 wherein said foil is transverse to said remote opening and said transverse planar member includes a pair of spaced, plated through eyelets connected to said foil and said conductors.

5. An initiator for detonation of a detonating cord connecting to plural shaped charges in a well borehole, comprising:

(a) a closed housing connected to an elongate explosive cord;

(b) secondary explosive charge means in said housing positioned relative to said explosive cord to detonate said cord;

(c) a barrel member having a passage therein wherein said passage has a face end spaced from a remote end;

(d) a sheet member of electrically insulated material spanning said remote passage end;

(e) a sacrificial metal foil member adjacent to said sheet member and aligned with said remote passage end and carried by a structural member;

(f) a pair of electrical conductors connected into said housing for electrical connection to said metal foil to deliver current through said housing to vaporize said foil on sufficient current flow; and (g) a sealant spread over a portion of said sheet member and foil to define a sealant surface cooperative with said sheet member and foil so that, on current flow through said foil, vaporization is momentarily confined by said sealant surface and said structural member.

6. The apparatus of claim 5 wherein said sealant is applied in a specified thickness, and the thickness of said sealant at said remote passage end is greater.

7. The apparatus of claim 5 wherein said sealant and said foil define a region of vaporization and said sheet material forms a flyer traveling in said passage to said charge means.

8. The apparatus of claim 5 wherein said sealant joins said sheet member and said structural member.

9. The apparatus of claim 5 wherein said foil is shaped as a strip across aid remote passage end.

10. An initiator for detonation of a detonating cord connecting to plural shaped charges in a well borehole, comprising:

(a) a closed housing connected to an elongate explosive cord;

(b) secondary explosive charge means in said housing positioned relative to said explosive cord to detonate said cord;

(c) a transverse structural member having a passage therein wherein said passage has a near end spaced from a remote end;

(d) a sheet member of electrically insulated material spanning said remote passage end;

(e) a sacrificial metal foil member adjacent to said sheet member and aligned with said passage end;

(f) a pair of electrical conductors connected into said housing for electrical connection to said metal foil to deliver current through said housing to vaporize said foil on sufficient current flow;

(g) a sealant spread over a portion of said sheet member and foil to define a sealant surface cooperative with said sheet member and foil so that, on current flow through said foil, vaporization is momentarily confined by said sealant surface; and (h) wherein said passage end of said foil member comprises a cutting edge adjacent to said sheet member, and said cutting edge forms a flyer from said sheet material for detonation of said charge means.

11. The apparatus of claim 10 wherein said sealant is applied in a specified thickness, and the thickness of said sealant at said remote passage end is greater.

12. The apparatus of claim 11 wherein said sealant and said foil define a region of vaporization and said sheet material forms a flyer traveling in said passage to said charge means.

13. An initiator for detonation of a detonating cord connecting to plural shaped charges in a well borehole, comprising:

(a) a closed housing connected to an elongate explosive cord;

(b) secondary explosive charge means in said housing positioned relative to said explosive cord to detonate said cord;

(c) a transverse structural member having a passage therein wherein said passage has a near end spaced from a remote end;

(d) a sheet member of electrically insulated material spanning said remote passage end;

(e) a sacrificial metal foil member adjacent to said sheet member and aligned with said passage end;

(f) an elongate firing line from a remote current source connected to said foil member to deliver sufficient current to vaporize said foil; and (g) a sealant sheet over said foil to confine vaporization to direct a flyer from said sheet material along said passage for detonation of said charge means.

* * * * *